US010753667B2

(12) United States Patent
Zhu et al.

(10) Patent No.: US 10,753,667 B2
(45) Date of Patent: Aug. 25, 2020

(54) BRANCHING AIR SUPPLY DEVICE AND REFRIGERATOR WITH BRANCHING AIR SUPPLY DEVICE

(71) Applicant: QINGDAO HAIER JOINT STOCK CO., LTD., Qingdao, Shandong Province (CN)

(72) Inventors: Xiaobing Zhu, Qingdao (CN); Xueli Cheng, Qingdao (CN); Bin Fei, Qingdao (CN); Riyong Lu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 331 days.

(21) Appl. No.: 15/547,495

(22) PCT Filed: Jun. 8, 2016

(86) PCT No.: PCT/CN2016/085341
§ 371 (c)(1),
(2) Date: Jul. 29, 2017

(87) PCT Pub. No.: WO2017/036223
PCT Pub. Date: Mar. 9, 2017

(65) Prior Publication Data

US 2018/0180345 A1 Jun. 28, 2018

(30) Foreign Application Priority Data

Aug. 28, 2015 (CN) ..... 2015 1 0540309

(51) Int. Cl.
*A47J 47/00* (2006.01)
*F25D 17/06* (2006.01)
(Continued)

(52) U.S. Cl.
CPC ..... *F25D 17/065* (2013.01); *F04D 27/003* (2013.01); *F04D 29/4246* (2013.01);
(Continued)

(58) Field of Classification Search
CPC .. F25D 17/065; F25D 27/003; F25D 29/4246; F25D 17/04; F25D 17/045; F25D 11/02
(Continued)

(56) References Cited

U.S. PATENT DOCUMENTS 5,735,138 A 4/1998 Park et al.
7,626,819 B1 * 12/2009 Chen ..... G06F 1/20 361/694

FOREIGN PATENT DOCUMENTS

CN 1155062 A 7/1997
CN 1708664 A 12/2005
(Continued)

OTHER PUBLICATIONS

English Abstract translation of documents Jp 2001280800A and Fr-2516213-Al.*

*Primary Examiner* — Helena Kosanovic
(74) *Attorney, Agent, or Firm* — Cheng-Ju Chiang

(57) ABSTRACT

A branching air supply device for a refrigerator, comprising: a housing provided with at least one air inlet and a plurality of air outlets; an adjusting piece configured to completely shield, partially shield or completely expose each air outlet in a controlled manner, so as to regulate respective air discharging areas of the plurality of air outlets; and an air-feeding device configured to enable air flow to flow into the housing from the at least one air inlet and to flow out of the housing via one or more air outlets of the plurality of the air outlets.

20 Claims, 8 Drawing Sheets

(51) Int. Cl.

| | |
|---|---|
| ***F25D 17/04*** | (2006.01) |
| ***F04D 29/42*** | (2006.01) |
| ***F04D 27/00*** | (2006.01) |
| *F25D 11/02* | (2006.01) |

(52) U.S. Cl.
CPC ..... *F25D 17/04* (2013.01); *F25D 17/045* (2013.01); *F25D 11/02* (2013.01)

(58) Field of Classification Search
USPC ..... 454/183, 184
See application file for complete search history.

(56) References Cited

FOREIGN PATENT DOCUMENTS

| | | | | | |
|---|---|---|---|---|---|
| CN | 204923642 | U | | 12/2015 | |
| CN | 205002482 | U | | 1/2016 | |
| CN | 205002483 | U | | 1/2016 | |
| CN | 205002484 | U | | 1/2016 | |
| CN | 205002485 | U | | 1/2016 | |
| CN | 205002486 | U | | 1/2016 | |
| CN | 205014737 | U | | 2/2016 | |
| CN | 205014738 | U | | 2/2016 | |
| CN | 205014739 | U | | 2/2016 | |
| CN | 205119611 | U | | 3/2016 | |
| CN | 205192043 | U | | 4/2016 | |
| EP | 2789937 | A1 | | 10/2014 | |
| FR | 2516213 | A1 | * | 5/1983 | ..... B60H 1/00471 |
| JP | H6-180175 | A | | 6/1994 | |
| JP | 2001280800 | A | * | 10/2001 | |
| WO | 2009/069900 | A2 | | 6/2009 | |

* cited by examiner

BRANCHING AIR SUPPLY DEVICE AND REFRIGERATOR WITH BRANCHING AIR SUPPLY DEVICE

CROSS REFERENCE TO RELATED APPLICATIONS

The present application is a 35 U.S.C. § 371 National Phase conversion of International (PCT) Patent Application No. PCT/CN2016/085341, filed on Jun. 8, 2016, which claims benefit of Chinese patent application No. 201510540309.4 filed on Aug. 28, 2015, the disclosure of which is incorporated by reference herein. The PCT International Patent Application was filed and published in Chinese.

TECHNICAL FIELD

The present invention relates to a refrigeration device, and more particularly, to a branching air supply device and a refrigerator having the same.

BACKGROUND

In recent years, with the improvement of people's living standards and the enhancement of environmental consciousness, the requirements to the refrigerator are gradually transferred from the low-temperature refrigeration to the preservation performance of food. So the air-cooled refrigerator is favored gradually by people.

With respect to the air-cooled refrigerator, the preservation performance of food largely depends on air circulation in the storage compartments of the air-cooled refrigerator and the temperature difference between various parts inside the refrigerator. If the air circulation inside the refrigerator is reasonable, the smaller the temperature difference is, the better the preservation performance of the refrigerator will be. Moreover, the key component to determine whether the air circulation inside the refrigerator is reasonable is an air passage, which controls the air direction and flow rate of the refrigerator and directly determines the refrigeration and preservation effects of the refrigerator.

Furthermore, in order to optimize the storage space, a single storage compartment is divided into a plurality of specific storage spaces via a shelf device such as a shelf or a drawer generally; and depending on the number of items stored in each storage space, the amounts of refrigeration air required by the storage spaces are also different. Thus, the refrigeration air directly entering the storage compartment without control from somewhere thereof will cause excessive cooling for part of storage spaces but lack of refrigeration air for others.

In the air passage design of the current air-cooled refrigerator on the market, a part of the air-cooled refrigerators outputs air from a freezing compartment and directly transfers the air to a refrigeration compartment. With respect to a common air-cooled refrigerator, there is no air door between the freezing compartment and the refrigeration compartment, and various air paths on the air passage are connected in series. When the temperature in the refrigeration compartment reaches a set temperature, cold air of the freezing compartment continues to flow into the refrigeration compartment. As a result, the temperature of the refrigeration compartment will be in a state of cyclical fluctuations. That is, the temperature inside the refrigeration compartment is always changing, thereby greatly affecting the preservation performance of the refrigerator.

In the air passage design of the current air-cooled refrigerator on the market, there is also a part of air-cooled refrigerators in which an evaporator is provided inside in a single accommodation compartment, the accommodation compartment of the evaporator is communicated with each storage compartment by using a complex air passage system, and refrigeration air generated by the evaporator is transferred to each storage compartment by using a fan. A control device (such as an electric air door) is provided in the air passage to control opening and closing of the air passage communicated with each storage compartment, or regulate the amount of air inside each storage compartment. But this structure is more complex, and inconvenient for unified control. In addition, it is also impossible to distribute and regulate the refrigeration air entering each storage compartment according to the requirement of each storage space to the refrigeration air supply amount.

SUMMARY

An objective of the first aspect of the present invention is to overcome a defect of a conventional air-cooled refrigerator and to provide a branching air supply device for a refrigerator, so as to facilitate uniform regulation of the flow path and the flow rate of refrigeration air and improve the air supply efficiency.

An objective of the second aspect of the present invention is to provide a refrigerator having the branching air supply device.

According to the first aspect of the present invention, the present invention provides a branching air supply device, which comprises: a housing provided with at least one air inlet and a plurality of air outlets; an adjusting piece configured to completely shield, partially shield or completely expose each air outlet in a controlled manner, so as to regulate respective air discharging areas of the plurality of air outlets; and an air-feeding device configured to enable air flow to flow into the housing from the at least one air inlet and to flow out of the housing via one or more air outlets of the plurality of the air outlets.

Optionally, the air-feeding device is a centrifugal impeller which is provided in the housing.

Optionally, the housing comprises: a base whose circumferential edge consists of a first edge section and a second edge section, the first edge section being in a shape of a circular arc; and a circumferential wall provided with a first circumferential wall section and a second circumferential wall section which respectively extend from the first edge section and the second edge section to one side of the base, the plurality of air outlets being formed in the first circumferential wall section.

Optionally, the housing further comprises a distributor cover, the distributor cover covering one end, away from the base, of the circumferential wall, and the at least one air inlet being formed in the distributor cover.

Optionally, a mounting groove is formed in an inner surface of the base, and the air-feeding device is mounted in the mounting groove.

Optionally, the adjusting piece comprises one or more shielding portions arranged in the circumferential direction of the base at intervals, wherein at least part of the surface, facing the circumferential wall, of each shielding portion is arranged coaxially with the first circumferential wall section; and the adjusting piece is rotatably mounted to the housing about an axis of the first circumferential wall section, such that the one or more shielding portions completely shield, partially shield or completely expose each air outlet in a controlled manner when the adjusting piece is rotated to different rotation positions.

Optionally, the adjusting piece further comprises at least one circulation portion, the shielding portions and the circulation portion are sequentially arranged in the circumferential direction of the base, one or more shielding portions and the at least one circulation portion form a cylindrical structure, and one or more circulation holes are formed in each circulation portion; the adjusting piece is further configured to allow air flow into enter the partially shielded or completely exposed air outlets via the circulation hole(s) in the at least one circulation portion when the adjusting piece is rotated to different rotation positions.

Optionally, the adjusting piece further comprises a rotation disc portion coaxial with the first circumferential wall section, and each shielding portion extends out from one surface of the rotation disc portion.

Optionally, the branching air supply device further comprises: a motor provided at a radially outer side of the rotation disc portion; a gear mounted on an output shaft of the motor; and a gear ring engaged with the gear, wherein the gear ring comprises an annular rib which extends out from the other surface of the rotation disc portion and is coaxial with the rotation disc portion, and a plurality of teeth which extend out from the outer circumferential surface of the annular rib and are arranged in the circumferential direction of the annular rib at intervals; or the gear ring is independent, and is fixed to the other surface of the rotation disc portion coaxially with the rotation disc portion.

Optionally, the rotation disc portion is ring-shaped, an annular groove is formed in the inner surface of the base, and the gear ring and the rotation disc portion are mounted in the annular groove; or the rotation disc portion is ring-shaped and mounted at one end, away from the base, of the circumferential wall.

Optionally, the number of the air outlets is three, which are sequentially arranged in the circumferential direction of the base at intervals. The number of the shielding portions and the circulation portions may be two respectively, wherein the two shielding portions are a first shielding portion and a second shielding portion respectively. The two circulation portions are a first circulation portion and a second circulation portion respectively, wherein the first shielding portion is configured to completely shield one of the air outlets, and the second shielding portion is configured to at least completely shield two of the air outlets. The first circulation portion is provided with a circulation hole. The second circulation portion is provided with three circulation holes which are sequentially provided in the circumferential direction of the base at intervals. Each circulation hole is configured to completely expose one of the air outlets, and the three circulation holes in the second circulation portion are configured to completely expose three of the air outlets.

Optionally, the base is ring-shaped, such that the air-feeding device is allowed to extend to the housing from a center ring hole defined by the base when the air-feeding device and the base are mounted in other components of the refrigerator respectively.

According to the second aspect of the present invention, the present invention provides a refrigerator, which comprises an air passage assembly and any of the above-mentioned branching air supply devices, wherein an air inlet passage, a plurality of air outlet passages and an accommodation space are defined in the air passage assembly; each air outlet passage is provided with one or more refrigeration air outlets; the plurality of air outlet passages are configured to enable air flow flowing out of the air passage assembly to enter a plurality of storage compartments of the refrigerator respectively, or enable air flow flowing out of the air passage assembly to enter one storage compartment of the refrigerator respectively from a plurality of positions on a compartment wall of the storage compartment; the branching air supply device is provided in the accommodation space; at least one air inlet of the branching air supply device is communicated with the air inlet passage; the plurality of air outlets of the branching air supply device are communicated with the plurality of air outlet passages respectively.

Optionally, the base of the housing of the branching air supply device is ring-shaped; and the air-feeding device of the branching air supply device is mounted on a bottom wall of the accommodation space and extends into the housing from a center ring hole defined by the base.

Since each of the branching air supply device and the refrigerator of the present invention comprises a plurality of air outlets, the adjusting piece can shield the plurality of air outlets in a controllable manner, such that an air outlet passage can be selected and the amount of air from each air outlet passage can be regulated. Therefore, the reasonable distribution of refrigeration air can be performed according to the requirement of different storage compartments to the refrigeration air supply amount or the requirement to the to the refrigeration air supply amount at different positions of one storage compartment, and thus the preservation performance and operating efficiency of the refrigerator are enhanced.

Further, since each of the branching air supply device and the refrigerator of the present invention is provided with the air-feeding device, the air supply efficiency of the branching air supply device is improved significantly, so that the branching air supply device can be independently introduced with air, and is thus especially applicable to a dual-system or multi-system refrigerator.

Further, in the branching air supply device and the refrigerator of the present invention, a rotation motion outputted by the motor is transferred by the gear and the gear ring to the adjusting piece at a reduced speed, such that the influence of jittering of an output shaft of the motor on rotation of the adjusting piece can be reduced. Therefore, accurate rotation of the adjusting piece can be realized, and the adjusting piece can be rotated to a predetermined position correctly to ensure that each air outlet can be accurately shielded or exposed. Furthermore, the gear and gear ring may also have deceleration and torque increase effects, and thus eliminate blocking when the motor rotates.

The above and other objects, advantages and features of the present invention will become more apparent to those skilled in the art according to the following detailed description of specific embodiments of the present invention in conjunction with the accompanying drawings.

BRIEF DESCRIPTION OF THE DRAWINGS

The followings will describe some embodiments of the present invention in detail in an exemplary rather than restrictive manner with reference to the accompanying drawings. The same reference signs in the drawings represent the same or similar components or parts. Those skilled in the art shall understand that these drawings may not be necessarily drawn according to the scales. In the drawings.

DETAILED DESCRIPTION

Figure 1:
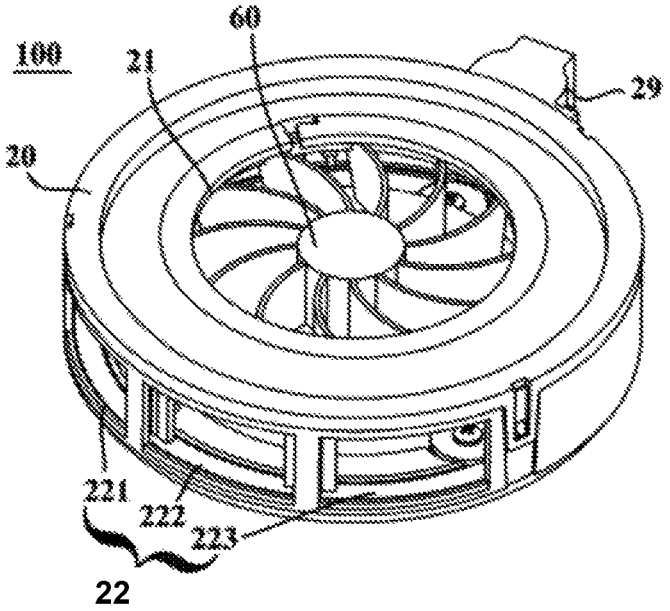
FIG. 1 is a schematic structure view of a branching air supply device according to an embodiment of the present invention.
Figure 2:
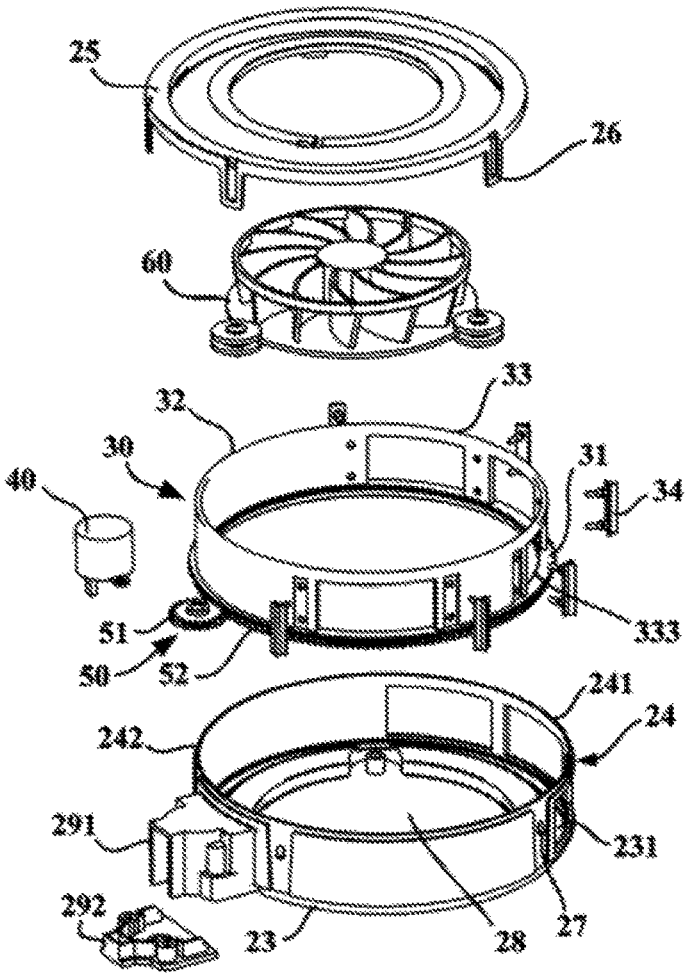
FIG. 2 is a schematically exploded view of the branching air supply device according to an embodiment of the present invention.

FIG. 1 is a schematic structure view of a branching air supply device 100 according to an embodiment of the present invention; FIG. 2 is a schematically exploded view of a branching air supply device 100 according to an embodiment of the present invention. As shown in FIG. 1 and FIG. 2, an embodiment of the present invention provides a branching air supply device 100. This branching air supply device 100 comprises a housing 20 and an adjusting piece 30. The housing 20 may be provided with at least one air inlet 21 and a plurality of air outlets 22, such that air flow can enter the housing 20 via the at least one air inlet 21, and then flow out of the housing 20 from the plurality of air outlets 22. The adjusting piece 30 may be configured to completely shield, partially shield or completely expose each air outlet 22 in a controlled manner, so as to regulate respective air discharging areas of the plurality of air outlets 22. For example, the adjusting piece 30 may completely shield, partially shield or completely expose each air outlet 22 when being at different positions. The adjusting piece 30 of the branching air supply device 100 in this embodiment of the present invention can distribute refrigeration air flowing from the air inlet 21 to the plurality of air outlets 22 in a controllable manner, control opening/closing of an air outlet passage 320 (see FIG. 14) communicated with each air outlet 22 and/or regulate the air amount in each air outlet passage 320, and further satisfy the requirement of different storage compartments 200 (see FIG. 13) to the refrigeration air supply amount, or the requirement to the refrigeration air supply amount at different positions of one storage compartment 200, or the requirement of different storage spaces in one storage compartment 200 to the refrigeration air supply amount.

In particular, the branching air supply device 100 in this embodiment of the present invention may further comprise an air-feeding device 60. The air-feeding device 60 is configured to enable air flow to flow into the housing 20 from the at least one air inlet 21 and to flow out of the housing 20 via one or more air outlets of the plurality of the air outlets 22, such that the air supply efficiency is improved. By means of the air-feeding device 60, the branching air supply device 100 in the embodiment of the present invention can also be independently introduced with air, and is thus especially applicable to a dual-system or multi-system refrigerator. Further, in some embodiments, the air-feeding device 60 may be a centrifugal impeller provided in the housing 20. In some alternative embodiments, the air-feeding device 60 may also be an axial flow fan, an axial flow air stack, or a centrifugal fan and is provided at the air inlet 21 of the housing 20. Of course, when the air-feeding device 60 is the centrifugal impeller and located in the housing 20, the branching air supply device 100 is compact in structure and small in volume.

In some embodiments of the present invention, the housing 20 of the branching air supply device 100 may comprise a base 23 and a circumferential wall 24. A circumferential edge of the base 23 consists of a first edge section and a second edge section, wherein the first edge section is preferably in a shape of a circular arc. The circumferential wall 24 is provided with a first circumferential wall section 241 and a second circumferential wall section 242 which respectively extend from the first edge section and the second edge section to one side of the base 23. A plurality of air outlets 22 may be formed in the first circumferential wall section 241. In some embodiments, the first circumferential wall section 241 may be a complete arc-shaped circumferential wall section provided with a plurality of air outlets 22, each of which may have an open edge. In other embodiments, the first circumferential wall section 241 may include at least three arc-shaped circumferential wall section portions, and gaps between every two of the arc-shaped circumferential wall section portions. The gap between every two of the arc-shaped circumferential wall section portions serves as one air outlet 22. During processing, only each of the arc-shaped circumferential wall section portions may be enabled to extend from a plurality of positions of the first edge section of the base 23 to one side of the base 23. Further, the second edge section is also preferably designed to be in a shape of a circular arc concentric with the first edge section, such that the first circumferential wall section 241 and the second circumferential wall section 242 are located in the same cylindrical circumferential wall, i.e., the first circumferential wall section 241 is coaxial with the second circumferential wall section 242.

Figure 12:
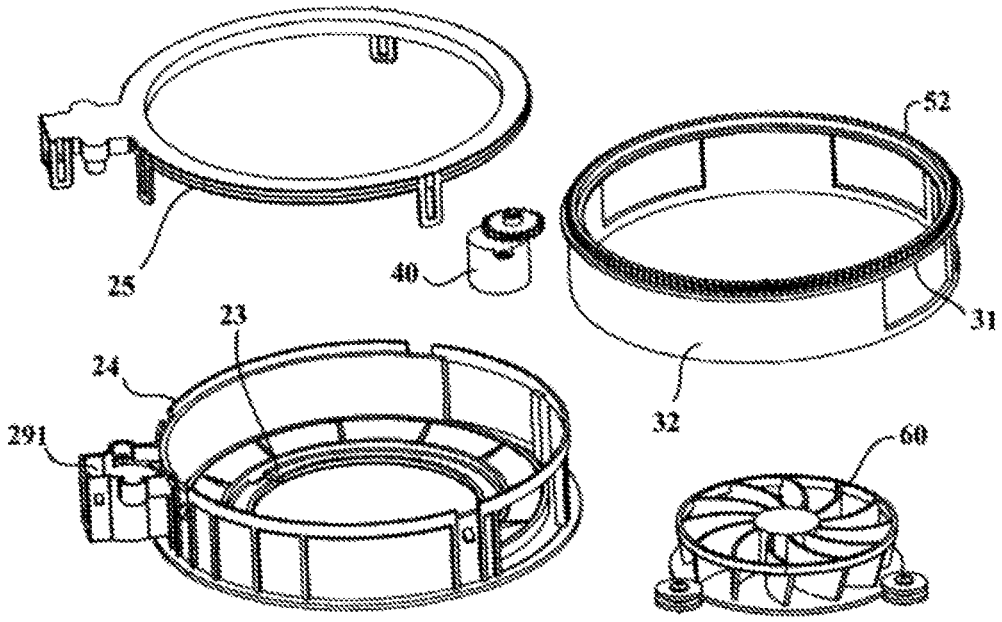
FIG. 12 is a schematic structure view of the branching air supply device according to an embodiment of the present invention.

In some embodiments of the present invention, a mounting groove 28 is also formed in the inner surface of the base 23, and the air-feeding device 60 is mounted in the mounting groove 28. For example, the centrifugal impeller is mounted to the inner surface of the mounting groove 28. In some other embodiments of the present invention, as shown in FIG. 12, the base 23 is ring-shaped, such that the air-feeding device 60 is allowed to extend to the housing 20 from a center ring hole defined by the base 23 when the air-feeding device 60 and the base 23 are mounted in other components of the refrigerator respectively. In particular, the air-feeding device 60 may be mounted on a bottom wall of an accommodation space 330 of the air passage assembly 300 of the refrigerator, and extends into the housing 20 from a center ring hole defined by the base 23. During mounting, the air-feeding device 60 is mounted in the air passage assembly 300 first, and then the housing 20 of the branching air supply device 100 is sleeved on the periphery of the air-feeding device 60.

In some further embodiments of the present invention, the housing 20 further comprises a distributor cover 25. The distributor cover 25 covers one end, away from the base 23, of the first peripheral wall section 241 to define an air passage space, i.e., an internal space of the housing 20, together with the base 23 and the circumferential wall 24. In order to facilitate the mounting of the distributor cover 25, the housing 20 may also comprise a plurality of clamping arms 26 extending from a plurality of positions on the edge of the distributor cover 25 to the base 23, respectively. A clamping groove or a bulge is formed on the inner surface of each connecting arm 26. A plurality of bulges 27 or clamping grooves correspondingly matched with the clamping grooves or the bulges are formed on the outer surface of the first circumferential wall section 241, such that the distributor cover 25 is clamped with the base 23. At least one air inlet 21 may be formed in the distributor cover 25. In some alternative embodiments of the present invention, the housing 20 does not comprise a distributor cover 25, and an end opening in one end, away from the base 23, of the circumferential wall 24 may serve as an air inlet 21 of the housing 20.

In some embodiments of the present invention, the adjusting piece 30 may comprise one or more shielding portions 32 arranged in the circumferential direction of the base at intervals, wherein at least part of the surface, facing the circumferential wall 24, of each shielding portion 32 is arranged coaxially with the first circumferential wall section 241. The adjusting piece 30 is rotatably mounted to the housing 20 about an axis of the first circumferential wall section 241, such that one or more shielding portions 32 completely shield, partially shield or completely expose each air outlet 22 in a controlled manner when the adjusting piece 30 is rotated to different rotation positions. In particular, each shielding portion 32 may be an arc-shaped baffle plate which is configured to shield or expose each air outlet 22. The shielding portion 32 of the adjusting piece 30 may be mounted in the housing 20, or outside the housing 20. In the case that the shielding portion 32 of the adjusting piece 30 is mounted in the housing 20 and the adjusting piece 30 is rotated about the axis of the first circumferential wall section 241, the outer side surface of the arc-shaped baffle plate can always be attached to the inner side surface of the first circumferential wall section 241 in a sealing manner, so that the arc-shaped baffle plate can open or close one or more air outlets 22 in a controlled manner when being at different rotation positions.

In some further embodiments of the present invention, as shown in FIG. 2, the adjusting piece 30 further comprises at least one circulation portion 33. The shielding portions 32 and the circulation portion 33 are sequentially arranged in the circumferential direction of the base 23. One or more shielding portions 32 and the at least one circulation portion 33 form a cylindrical structure. One or more circulation holes 333 are formed in each circulation portion 33. The adjusting piece 30 is further configured to allow air flow into enter the partially shielded or completely exposed air outlets 22 via the circulation hole(s) 333 in the at least one circulation portion 33 when the rotating component 30 is rotated to different rotation positions.

In particular, in some embodiments, the number of the air outlets 22 may be three, and the air outlets are sequentially arranged in the circumferential direction of the base 23 at intervals. The three air outlets 22 include a first air outlet 221, a second air outlet 222 and a third air outlet 223 which can be sequentially arranged anticlockwise in the circumferential direction of the base 23. The number of the shielding portions and the circulation portions may be two respectively. The two shielding portions 32 include a first shielding portion 321 and a second shielding portion 322. The two circulation portions 33 include a first circulation portion 331 and a second circulation portion 332 which can be sequentially arranged anticlockwise in the circumferential direction of the base 23. The first shielding portion 321 is configured to completely shield one of the air outlets 22. The second shielding portion 322 is configured to at least completely shield two of the air outlets 22, e.g., the second shielding portion 322 can at least completely shield three of the air outlets 22. The first circulation portion 331 is provided with a circulation hole 333. The second circulation portion 332 is provided with three circulation holes 333 which are sequentially provided in the circumferential direction of the base 23 at intervals. Each circulation hole 333 is configured to completely expose one of the air outlets 22, and the three circulation holes 333 in the second circulation portion 332 are configured to completely expose three of the air outlets 22.

Figure 3:
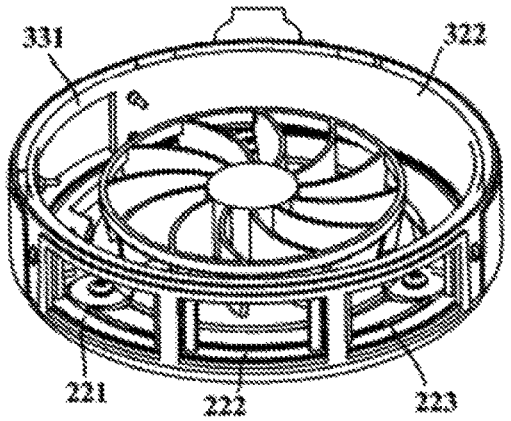
FIGS. 3 to 10 are schematically partial structure views respectively illustrating that an adjusting piece in the branching air supply device is at different rotation positions according to embodiments of the present invention.
Figure 4:
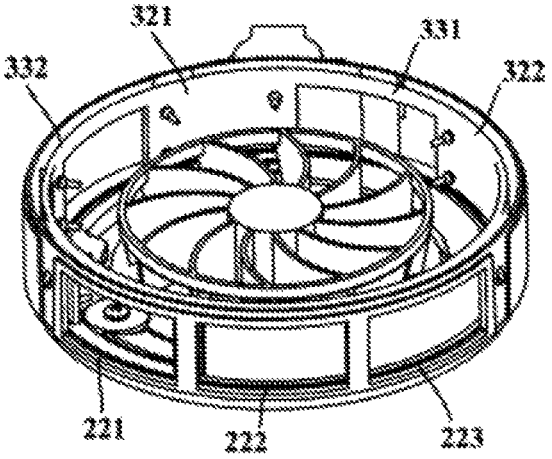
Figure 5:
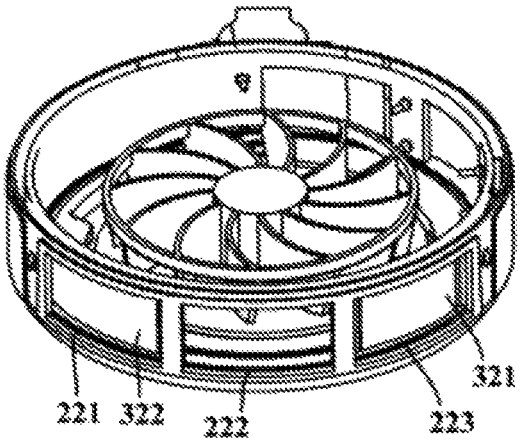
Figure 6:
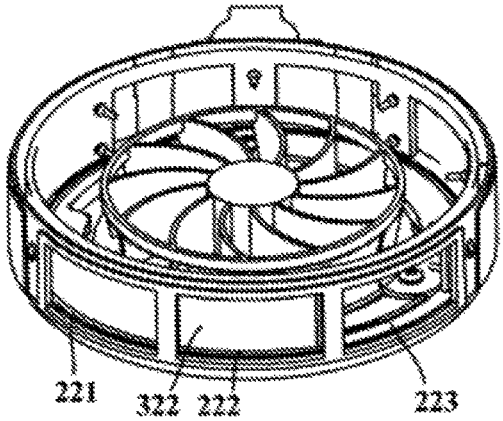

FIGS. 3 to 10 are schematically partial structure views respectively illustrating that an adjusting piece 30 in a branching air supply device 100 is at different rotation positions according to embodiments of the present invention. When the first shielding portion 321 and the second shielding portion 322 are rotated to positions as shown in FIG. 3, the three circulation holes 333 in the second circulation portion 332 can allow the first air outlet 221, the second air outlet 222 and the third air outlet 223 to be in an open state respectively. When the first shielding portion 321 and the second shielding portion 322 are rotated to positions as shown in FIG. 4, the second shielding portion 322 can completely shield the second air outlet 222 and the third air outlet 223, and the circulation hole 333 in the second circulation portion 322 can allow the first air outlet 221 to be completely exposed. When the first shielding portion 321 and the second shielding portion 322 are rotated to positions as shown in FIG. 5, the first shielding portion 321 can completely shield the third air outlet 223, the second shielding portion 322 can completely shield the first air outlet 221, and the circulation hole in the first circulation portion 331 can allow the second air outlet 222 to be completely exposed. When the first shielding portion 321 and the second shielding portion 322 are rotated to positions as shown in FIG. 6, the second shielding portion 322 can completely shield the first air outlet 221 and the second air outlet 222, and the circulation hole 333 in the first circulation portion 331 can allow the third air outlet 223 to be completely exposed.

Figure 7:
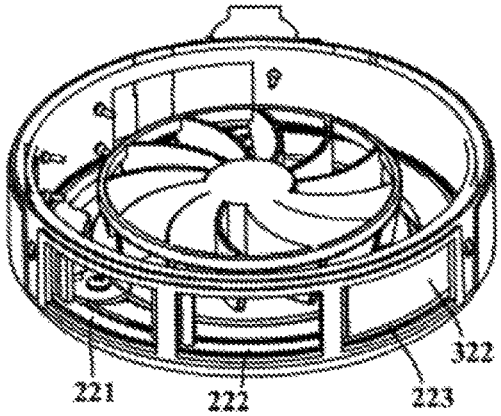
Figure 8:
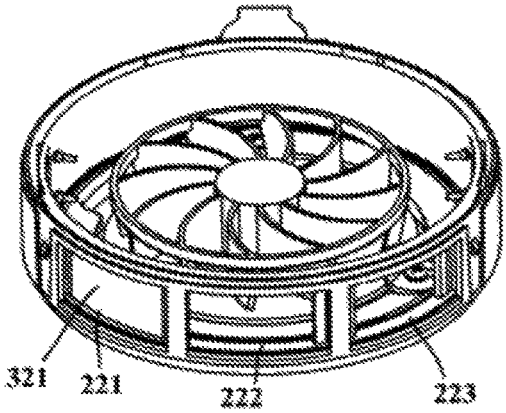
Figure 9:
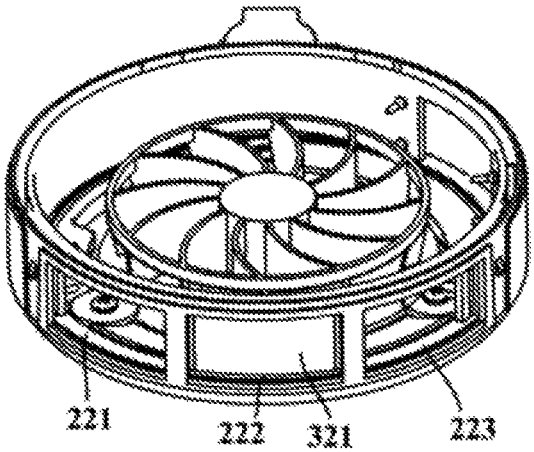
Figure 10:
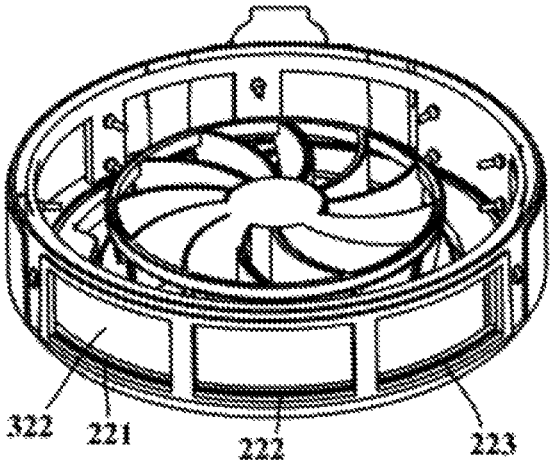

When the first shielding portion 321 and the second shielding portion 322 are rotated to positions as shown in FIG. 7, the second shielding portion 322 can completely shield the third air outlet 223, and the two circulation holes 333 in the second circulation portion 332 can allow the first air outlet 221 and the second air outlet 222 to be completely exposed. When the first shielding portion 321 and the second shielding portion 322 are rotated to positions as shown in FIG. 8, the first shielding portion 321 can only completely shield the first air outlet 221, and the two circulation holes 333 in the second circulation portion 332 can allow the second air outlet 222 and the third air outlet 223 to be completely exposed. When the first shielding portion 321 and the second shielding portion 322 are rotated to positions as shown in FIG. 9, the first shielding portion 321 can completely shield the second air outlet 222, the circulation hole 333 in the first circulation portion 331 can allow the first air outlet 221 to be completely exposed, and one circulation hole 333 in the second circulation portion 332 can allow the third air outlet 223 to be completely exposed. When the first shielding portion 321 and the second shielding portion 322 are rotated to positions as shown in FIG. 10, the second shielding portion 322 can completely shield the first air outlet 221, the second air outlet 222 and the third air outlet 223. Of course, the first shielding portion 321 and the second shielding portion 322 may also be rotated to other rotation positions so as to regulate the air path and the air amount.

Figure 11:
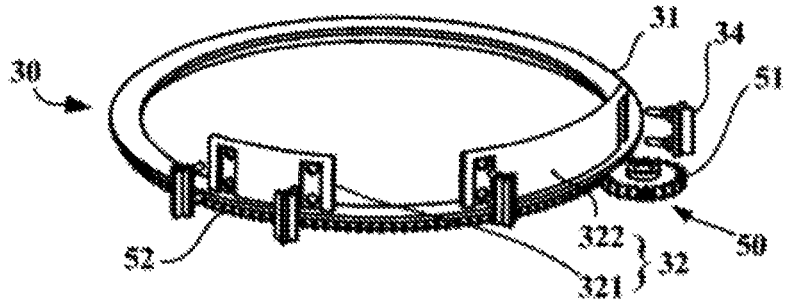
FIG. 11 is a schematically partial structure view of the branching air supply device according to an embodiment of the present invention.

In the other further embodiments of the present invention, as shown in FIG. 11, if only one shielding portion 32 is included, both sides of the shielding portion 32 allow air flow to flow through. If the adjusting piece 30 comprises a plurality of shielding portions 32, a gap between every two adjacent shielding portions 32 may allow air flow to flow through.

In particular, in some embodiments, the number of the air outlets 22 may be three, and the air outlets are sequentially arranged in the circumferential direction of the base 23 at intervals. The three air outlets 22 include a first air outlet 221, a second air outlet 222 and a third air outlet 223 which can be sequentially arranged anticlockwise in the circumferential direction of the base 23. The number of the shielding portions 32 may be two. The two shielding portions 32 are a first air outlet 321 and a second shielding portion 322 respectively, which can be sequentially arranged anticlockwise in the circumferential direction of the base 23 at intervals. The first shielding portion 321 may be configured to completely shield one of the air outlets 22. The second shielding portion 322 may be configured to completely shield two of the air outlets 22. A gap between the first shielding portion 321 and the second shielding portion 322 may be configured to completely expose one of the air outlets 22. When neither the first shielding portion 321 nor the second shielding portion 322 shields the air outlet, the first, second and third air outlets 221, 222 and 223 are in an open state respectively. When the second shielding portion 322 completely shields the second and third air outlets 222 and 223, a gap between the two shielding portions 32 may allow the first air outlet 221 to be completely exposed. When the first shielding portion 321 may completely shield the first air outlet 221, the second baffle plate 322 may completely shield the third air outlet 223, and the gap between the two shielding portions 32 may allow the second air outlet 222 to be completely exposed. When the second shielding portion 322 may completely shield the first and second air outlets 221 and 222, the third air outlet 223 is completely exposed. When the second shielding portion 321 may completely shield the third air outlet 223, the first and second air outlets 221 and 222 are completely exposed. When the second shielding portion 322 may only completely shield the first air outlet 221, the second and third air outlets 222 and 223 are completely exposed. When the first shielding portion 321 may completely shield the second air outlet 222, the first air outlet 221 is completely exposed, and a gap between the two shielding portions 32 may allow the third air outlet 223 to be completely exposed.

In some embodiments of the present invention, in order to facilitate the rotation of the adjusting piece 30, a distance between each of the shielding portions 32 and the first circumferential wall section 241 can be slightly increased; however, if the distance between each of the shielding portions 32 and the first circumferential wall section 241 is increased, cold air leakage will occur, resulting in an incomplete and useless shielding effect, i.e., air flow can flow to one air outlet 22 from another air outlet 22 via the gap between the first circumferential wall section 241 and each of the shielding portions 32. Therefore, the branching air supply device 100 in the embodiments of the present invention further comprises a sealing device configured to at least partially prevent the air flow from flowing to each air outlet 22 via a gap between the outer surface of each shielding portion 32 and the inner surface of the first circumferential wall section 241. In particular, the sealing device may comprise at least two sealing gaskets 34, each of which extends in a direction parallel to the rotating axis of the adjusting piece 30. A sealing gasket 34 is provided at each of the two ends of the arcuate outer surface of each shielding portion 32 along its rotating direction. In the case that the adjusting piece 30 comprises the shielding portions 32 and the circulation portions 33, the sealing device may further comprise other sealing gaskets 34 which may be provided between every two adjacent circulation holes 333 in each circulation portion 33.

In some embodiments of the present invention, the adjusting piece 30 may further comprise a rotation disc portion 31 coaxial with the first circumferential wall section 241 Each shielding portion 32 extends out from one surface of the rotation disc portion 31. The rotation disc portion 31 may be disc-shaped or ring-shaped, and the full-circumferential structure allows the movement of the adjusting piece 30 to be more stable.

In some embodiments of the present invention, the branching air blowing device 100 may further comprise a motor 40 and a transmission mechanism 50. The motor 40 may be provided at a radially outer side of the rotation disc portion 31. The transmission mechanism 50 is configured to transfer a rotation motion outputted by the motor 40 to the adjusting piece 30 at a reduced speed. In a design process, the inventor found that the rotation of the adjusting piece 30 was not stable enough because of jittering of the motor 40. Therefore, the inventor proposed that the transmission mechanism 50 was used to reduce the influence of jittering of an output shaft of the motor 40, so as to enable accurate rotation of the adjusting piece 30. The deceleration and torque increase effects of the transmission mechanism 50 may also eliminate blocking of the motor 40. The overall thickness of the branching air supply device 100 can be reduced and the space is saved because the motor 40 is provided at a special position, and therefore, the branching air supply device 100 is especially applicable to a refrigerator.

In some embodiments of the present invention, the transmission mechanism 50 is preferably a gear transmission mechanism. In particular, the transmission mechanism 50 may comprise a gear 51 and a gear ring 52 engaged with the gear 51. The gear 51 may be mounted on the output shaft of the motor 40. The gear ring 52 may be integrally formed with or independently of the rotation disc portion 31, and fixed to the rotation disc portion 31. For example, the gear ring 52 comprises an annular rib which extends out from the other surface of the rotation disc portion 31 and is coaxial with the rotation disc portion 31, and a plurality of teeth which extend out from the outer circumferential surface of the annular rib and are arranged in the circumferential direction of the annular rib at intervals. Alternatively, the gear ring 52 is independent, and is fixed to the other surface of the rotation disc portion 31 coaxially with the rotation disc portion 31. Further, in some embodiments, as shown in FIG. 2, an annular groove 231 is formed in the inner surface of the base 23, and the gear ring 52 is mounted in the annular groove 231, such that the adjusting piece 30 can be moved stably. Preferably, the rotation disc portion 31 may be ring-shaped; and the annular groove 231 may be a stepped groove and also configured to accommodate the rotation disc portion 31 to further ensure the movement stability of the adjusting piece 30. For the sake of further preventing jittering of the adjusting piece 40 in a rotation process, the housing 20 may further comprise a plurality of hooks which are uniformly distributed on the inner surface of the base 23 in the circumferential direction of the base 23 and are located in a center ring hole defined by the rotation disc portion 31. The rotation disc portion 31 and the gear ring 52 are clamped between a hook portion of each hook and the bottom surface of the annular groove 231. For the sake of protecting the motor 40, the housing 20 may further comprise a motor accommodation portion 29 provided on the outer surface of the first circumferential wall section 241 and/or the second circumferential wall section 242. An accommodation cavity for accommodating the gear 51 and the motor 40 is defined in the motor accommodation portion 29. The motor accommodation portion 29 may comprise a cavity portion 291 extending out from the outer surface of the first circumferential wall portion 241, and a cover plate portion 292 detachably mounted to the cavity portion. In some other embodiments, as shown in FIG. 12, the rotation disc portion 31 is ring-shaped, and may be mounted at one end, away from the base 23, of the circumferential wall 24.

Figure 13:
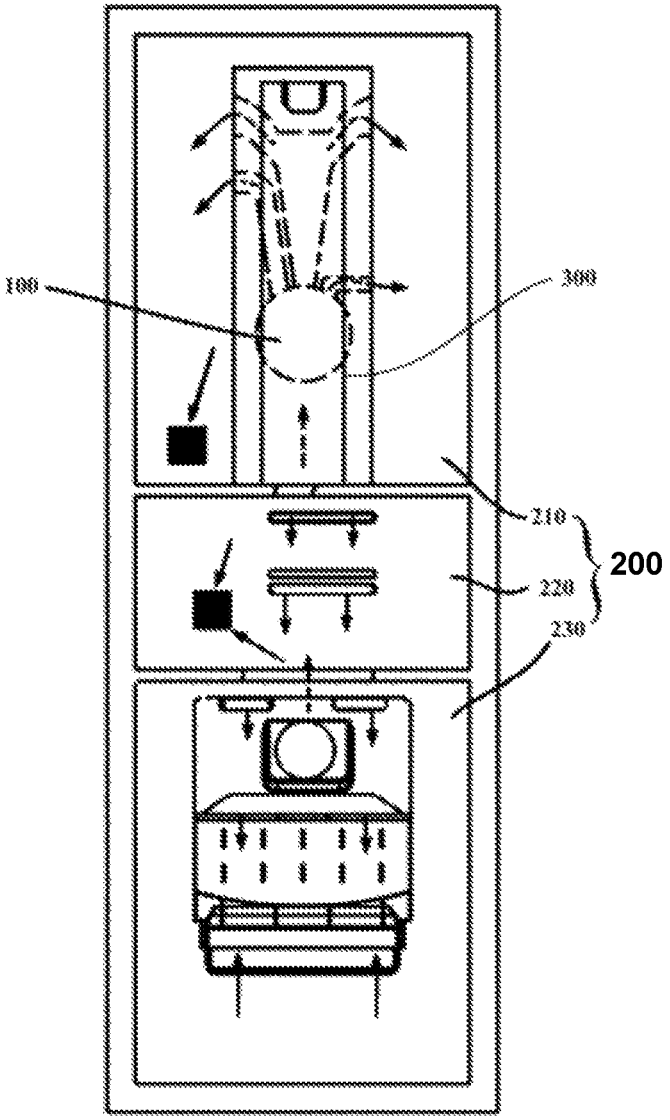
FIG. 13 is a schematic structure view of a refrigerator according to an embodiment of the present invention.
Figure 14:
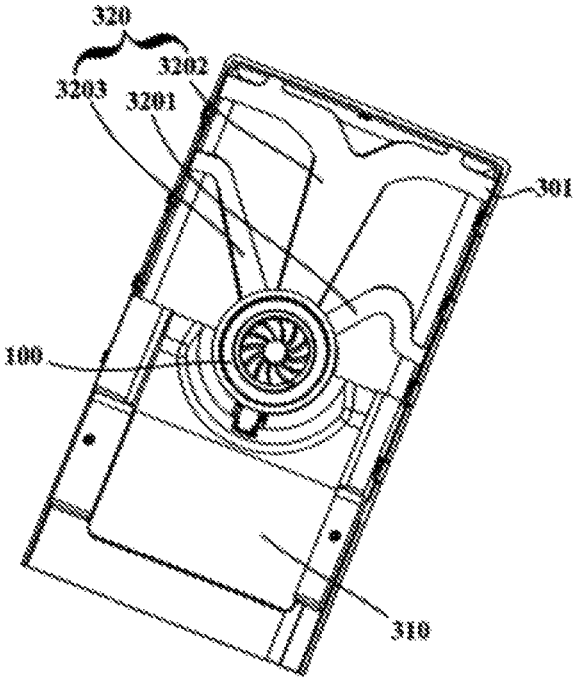
FIG. 14 is a schematic structure view in which the branching air supply device is mounted to an air passage assembly according to an embodiment of the present invention.

FIG. 13 is a schematic structure view of a refrigerator according to an embodiment of the present invention; FIG. 14 is a schematic structure view in which a branching air supply device 100 is mounted to an air passage assembly 300 according to an embodiment of the present invention. As shown in FIG. 13 and FIG. 14, the embodiment of the present invention further provides a refrigerator which is provided with one or more storage compartments 200. Each storage compartment 200 may also be divided into a plurality of storage spaces via a shelf plate or a shelf. Further, the refrigerator is also internally provided with an air passage assembly 300, and a branching air supply device 100 of any of the preceding embodiments, wherein the branching air supply device 100 is provided in the air passage assembly 300. The air passage assembly 300 may comprise a bottom plate 340 and a cover plate 350, which define the air inlet passage 310, the plurality of air outlet passages 320 and the accommodation space 330. Each air outlet passage 320 is provided with one or more refrigeration air outlets 301. The air inlet passage 310 may be communicated with a cooling compartment of the refrigerator to receive air flow cooled by a cooler in the cooling compartment. The branching air supply device 100 is provided in the accommodation space 330 of the air passage assembly 300. At least one air inlet 21 of the branching air supply device 100 is communicated with the air inlet passage 310, and a plurality of air outlets 22 of the branching air supply device 100 are communicated with the plurality of air outlet passages 320 respectively, such that air flow from the air inlet passage 310 enters the corresponding air outlet passage 320 in a controlled or distributable manner.

In some embodiments, the plurality of air outlet passages 320 are configured to enable air flow flowing out of the air passage assembly 300 to enter the plurality of storage compartments 200 of the refrigerator respectively. The branching air supply device 100 enables air flow from the air inlet passage 310 to enter the corresponding air outlet passage 320 in a controlled or distributable manner, and then enter the corresponding storage compartment 200. For example, the number of the air outlets 22 of the branching air supply device 100 may be three, such as a first air outlet 221, a second air outlet 222 and a third air outlet 223; the number of the air outlet passages 320 may be three; the plurality of storage compartments 200 may include a first storage compartment, a second storage compartment and a third storage compartment. When the first storage compartment needs refrigeration air, and the second storage compartment and the third storage compartment need no refrigerator air, the second air outlet 222 and the third air outlet 223 of the branching air supply device 100 are in a completely shielded state respectively, and the first air outlet 221 is in a completely exposed state. In particular, the refrigerator can control the rotation of the adjusting piece 30 according to a temperature detected by a temperature sensor in the refrigerator to realize corresponding control, and therefore refrigeration air can be distributed to the plurality of storage compartments 200 reasonably, and thus the preservation performance and operating efficiency of the refrigerator are enhanced.

In other embodiments, as shown in FIG. 13 and FIG. 14, solid arrows in FIG. 13 indicate the flowing directions of air flow in one or more storage compartments 200, and dotted arrows indicate the flowing directions of air flow in the air passages. The plurality of air outlet passages 320 may be configured to enable air flow flowing out of the air passage assembly 300 to enter one storage compartment 200 (e.g., the storage compartment 210) of the refrigerator from a plurality of positions on a compartment wall of the storage compartment 200. For example, the number of the air outlets 22 of the branching air supply device 100 may be three, such as a first air outlet 221, a second air outlet 222 and a third air outlet 223; the number of the air outlet passages 320 may be three, such as a first air passage 3201 communicated with the first air outlet 221, a second air passage 3202 communicated with the second air outlet 222 and a third air passage 3203 communicated with the third air passage 223. The second air passage 3202 may be provided with two or four refrigeration air outlets 301 which are symmetrically provided at the upper part of the rear wall of the storage compartment 200. The first air passage 3201 is located at one side of the second air passage 3202, provided with a refrigeration air outlet 301 and provided at the lower part of the rear wall of the storage compartment 200. The third air passage 3203 is located at the other side of the second air passage 3202, provided with a refrigeration air outlet 301 and provided in the middle of the rear wall of the storage compartment 200. Further, the storage compartment 200 may be divided into three storage spaces via two shelves, each air outlet passage 320 being communicated with one storage space. In this embodiment, the plurality of storage compartments 200 may include other storage compartments 200, such as a quick-freezing compartment 220 and a freezing compartment 230. The storage compartment 200 in this embodiment may also be referred to as a refrigeration compartment 210.

According to whether refrigeration air at each position of the storage compartment 200 of the refrigerator is sufficient or not, the refrigerator in this embodiment can control refrigeration air to flow into this position from the corresponding air outlet passage 320, such that refrigeration air can be distributed to different positions of the storage compartment 200 reasonably, and therefore the preservation performance and operating efficiency of the refrigerator are enhanced. The branching air supply device 100 can realize the regulation of the air direction and the air amount of the air outlet passage 320. Where the refrigeration air is needed in the storage compartment 200, the refrigeration air outlet 301 is opened there, and is then closed in case of no need for refrigeration air. Therefore, the constancy of the temperature inside the refrigerator is controlled, an optimal storage environment can be provided for food in the refrigerator, nutrition loss of food is reduced, power consumption of the refrigerator can be reduced, and energy sources can be saved.

Figure 15:
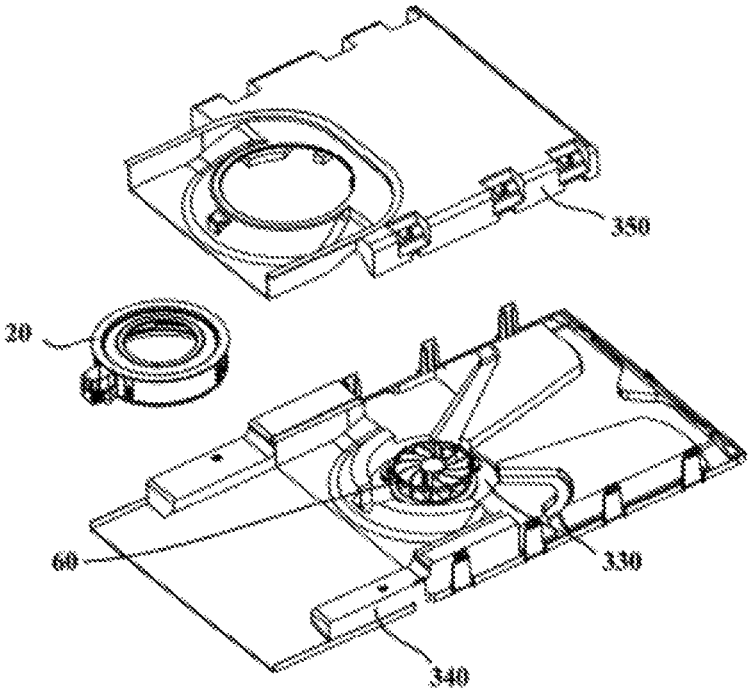
FIG. 15 is a schematically exploded view in which the branching air supply device is mounted to an air passage assembly according to an embodiment of the present invention.

FIG. 15 is a schematic structure view in which a branching air supply device 100 is mounted to the air passage assembly 300 according to an embodiment of the present invention. As shown in FIG. 15, the base 23 of the housing 20 of the branching air supply device 100 is ring-shaped. The air-feeding device 60 of the branching air supply device 100 may be mounted on a bottom wall of the accommodation space 330 of the air passage assembly 300, and extends into the housing 20 from a center ring hole defined by the base 23. In some other embodiments of the present invention, the air-feeding device 60 of the branching air supply device 100 may be fixed to the housing 20 to form an integral piece. During mounting, the branching air supply device 100 is assembled first, and then mounted in the accommodation space 330 of the air passage assembly 300.

Now, it should be realized that, although multiple exemplary embodiments of the present invention have been illustrated and described in detail, those skilled in the art may directly determine or derive various modifications or variations according with the principle of the present invention based on the content disclosed by the present invention, without departing from the spirit and scope of the invention. Thus, the scope of the present invention should be understood and deemed to include these and other modifications or variations.

What is claimed is:

1. A branching air supply device for a refrigerator, comprising:

a housing provided with at least one air inlet and a plurality of air outlets;

an adjusting piece configured to completely shield, partially shield or completely expose each air outlet in a controlled manner, so as to regulate respective air discharging areas of the plurality of air outlets; and an air-feeding device configured to enable air flow to flow into the housing from the at least one air inlet and to flow out of the housing via one or more air outlets of the plurality of the air outlets;

wherein the housing comprises:

a base whose circumferential edge consists of a first edge section and a second edge section, the first edge section being in a shape of a circular arc;

a circumferential wall provided with a first circumferential wall section and a second circumferential wall section which respectively extend from the first edge section and the second edge section to one side of the base, the plurality of air outlets being formed in the first circumferential wall section; and a distributor cover is clamped with the base by a plurality of clamping arms extending from the edge of the distributor cover towards the base, and the distributor cover covers one end of the circumferential wall which is away from the base, the at least one air inlet is formed in the distributor cover;

the adjusting piece comprises a plurality of shielding portions arranged in the circumferential direction of the base at intervals and a plurality of circulation portions; the adjusting piece is further configured to allow air flow into enter the partially shielded or completely exposed air outlets via circulation holes in the circulation portions when the adjusting piece is rotated to different rotation positions;

the adjusting piece further comprises a rotation disc portion coaxial with the first circumferential wall section, and each shielding portion extends out from one surface of the rotation disc portion;

the branching air supply device further comprises a motor provided at a radially outer side of the rotation disc portion, a gear mounted on an output shaft of the motor, and a gear ring engaged with the gear, the housing further comprises a motor accommodation portion provided on an outer surface of the circumferential wall, an accommodation cavity for accommodating the gear and the motor is defined in the motor accommodation portion, the motor accommodation portion comprises a cavity portion extending out from the outer surface of the circumferential wall, and a cover plate portion detachably mounted to the cavity portion.

2. The branching air supply device according to claim 1, wherein:

the air-feeding device is a centrifugal impeller which is provided in the housing.

3. The branching air supply device according to claim 1, wherein:

a mounting groove is formed in an inner surface of the base, the air-feeding device being mounted in the mounting groove.

4. The branching air supply device according to claim 1, wherein:

at least one part of a surface, facing the circumferential wall, of each shielding portion is arranged coaxially with the first circumferential wall section; and the adjusting piece is rotatably mounted to the housing about an axis of the first circumferential wall section, such that the plurality of shielding portions completely shield, partially shield or completely expose each air outlet in the controlled manner when the adjusting piece is rotated to different rotation positions.

5. The branching air supply device according to claim 4, wherein:

the plurality of shielding portions and the plurality of circulation portions are sequentially arranged in the circumferential direction of the base, and the plurality of shielding portions and the plurality of circulation portions form a cylindrical structure, one or more circulation holes being formed in each circulation portion.

6. The branching air supply device according to claim 1, wherein the gear ring comprises an annular rib which extends out from another surface of the rotation disc portion and is coaxial with the rotation disc portion, and a plurality of teeth which extend out from an outer circumferential surface of the annular rib and are arranged in the circumferential direction of the annular rib at intervals; or the gear ring is independent and is fixed to the another surface of the rotation disc portion coaxially with the rotation disc portion.

7. The branching air supply device according to claim 6, wherein:

the rotation disc portion is annular, and an annular groove is formed in an inner surface of the base, the gear ring and the rotation disc portion being mounted in the annular groove; or the rotation disc portion is annular and mounted at one end, away from the base, of the circumferential wall.

8. The branching air supply device according to claim 5, wherein:

the number of the air outlets is three, which are sequentially arranged in the circumferential direction of the base at intervals;

the number of the shielding portions and the circulation portions may be two respectively, wherein the two shielding portions are a first shielding portion and a second shielding portion respectively, and the two circulation portions are a first circulation portion and the second circulation portion respectively; and the first shielding portion is configured to completely shield one of the air outlets;

the second shielding portion is configured to at least completely shield two of the air outlets;

the first circulation portion is provided with a circulation hole, and the second circulation portion is provided with three circulation holes which are sequentially provided in the circumferential direction of the base at intervals, wherein each circulation hole is configured to completely expose one of the air outlets, and the three circulation holes in the second circulation portion are configured to completely expose three of the air outlets.

9. The branching air supply device according to claim 1, wherein:

the base is annular, such that the air-feeding device is allowed to extend to the housing from a center ring hole defined by the base when the air-feeding device and the base are mounted in other components of the refrigerator respectively.

10. A refrigerator, comprising:

an air passage assembly in which an air inlet passage, a plurality of air outlet passages and an accommodation space are defined, wherein each air outlet passage is provided with one or more refrigeration air outlets; the plurality of air outlet passages are configured to enable air flow flowing out of the air passage assembly to enter a plurality of storage compartments of the refrigerator respectively, or enable air flow flowing out of the air passage assembly to enter one storage compartment of the refrigerator respectively from a plurality of positions on a compartment wall of the storage compartment; and a branching air supply device comprising: a housing provided with at least one air inlet and a plurality of air outlets; an adjusting piece configured to completely shield, partially shield or completely expose each air outlet in a controlled manner, so as to regulate respective air discharging areas of the plurality of air outlets; and an air-feeding device configured to enable air flow to flow into the housing from the at least one air inlet and to flow out of the housing via one or more air outlets of the plurality of the air outlets, wherein the branching air supply device is provided in the accommodation space, at least one air inlet of the branching air supply device is communicated with the air inlet passage, and the plurality of air outlets of the branching air supply device are communicated with the plurality of air outlet passages respectively;

wherein the housing comprises:

a base whose circumferential edge consists of a first edge section and a second edge section, the first edge section being in a shape of a circular arc;

a circumferential wall provided with a first circumferential wall section and a second circumferential wall section which respectively extend from the first edge section and the second edge section to one side of the base, the plurality of air outlets being formed in the first circumferential wall section; and a distributor cover is clamped with the base by a plurality of clamping arms extending from the edge of the distributor cover towards the base, and the distributor cover covers one end of the circumferential wall which is away from the base, the at least one air inlet is formed in the distributor cover;

the adjusting piece comprises a plurality of shielding portions arranged in the circumferential direction of the base at intervals and a plurality of circulation portions; the adjusting piece is further configured to allow air flow into enter the partially shielded or completely exposed air outlets via circulation holes in the circulation portions when the adjusting piece is rotated to different rotation positions;

the adjusting piece further comprises a rotation disc portion coaxial with the first circumferential wall section, and each shielding portion extends out from one surface of the rotation disc portion;

the branching air supply device further comprises a motor provided at a radially outer side of the rotation disc portion, a gear mounted on an output shaft of the motor, and a gear ring engaged with the gear, the housing further comprises a motor accommodation portion provided on an outer surface of the circumferential wall, an accommodation cavity for accommodating the gear and the motor is defined in the motor accommodation portion, the motor accommodation portion comprises a cavity portion extending out from the outer surface of the circumferential wall, and a cover plate portion detachably mounted to the cavity portion.

11. The refrigerator according to claim 10, wherein:

a base of the housing of the branching air supply device is annular; and the air-feeding device of the branching air supply device is mounted on a bottom wall of the accommodation space, and extends to the housing from a center ring hole defined by the base.

12. The refrigerator according to claim 10, wherein the air-feeding device is a centrifugal impeller which is provided in the housing.

13. The refrigerator according to claim 10, wherein:

a mounting groove is formed in an inner surface of the base, the air-feeding device being mounted in the mounting groove.

14. The refrigerator according to claim 10, wherein:

at least one part of a surface, facing the circumferential wall, of each shielding portion is arranged coaxially with the first circumferential wall section; and the adjusting piece is rotatably mounted to the housing about an axis of the first circumferential wall section, such that the plurality of shielding portions completely shield, partially shield or completely expose each air outlet in the controlled manner when the adjusting piece is rotated to different rotation positions.

15. The refrigerator according to claim 14, wherein the shielding portions and the circulation portions are sequentially arranged in the circumferential direction of the base, and the plurality of shielding portions and the plurality of circulation portions form a cylindrical structure, one or more circulation holes being formed in each circulation portion.

16. The branching air supply device according to claim 1, wherein a clamping groove is formed on an inner surface of each connecting arm, a plurality of bulges correspondingly matched with the clamping grooves are formed on an outer surface of the first circumferential wall section.

17. The branching air supply device according to claim 1, wherein the branching air supply device further comprises a sealing device configured to at least partially prevent the air flow from flowing to each air outlet via a gap between an outer surface of each shielding portion and an inner surface of the first circumferential wall section.

18. The branching air supply device according to claim 17, wherein the sealing device comprises at least two sealing gaskets, each sealing gasket extends in a direction parallel to a rotating axis of the adjusting piece.

19. The branching air supply device according to claim 18, wherein one sealing gasket is provided at each of the two ends of the outer surface of each shielding portion along its rotating direction, and other sealing gaskets are provided between every two adjacent circulation holes in each circulation portion.

20. The refrigerator according to claim 10, wherein the air passage assembly comprises a bottom plate and a cover plate, which define the air inlet passage, the plurality of air outlet passages and the accommodation space, and the air inlet passage is communicated with a cooling compartment of the refrigerator to receive air flow cooled by a cooler in the cooling compartment.

* * * * *